United States Patent [19]

Schweinsberg

[11] 4,052,807

[45] Oct. 11, 1977

[54] DATA CARRIER HOLDER WITH IDENTIFICATION STRIP

[75] Inventor: Dieter Klaus-Jurgen Schweinsberg, Lautertal-Unterlauter, Germany

[73] Assignee: Eichner Organisation KG, Coburg, Germany

[21] Appl. No.: 687,597

[22] Filed: May 18, 1976

[30] Foreign Application Priority Data

Feb. 2, 1976 Germany ..... 2603793

[51] Int. Cl.[2] ..... B42F 21/00

[52] U.S. Cl. ..... 40/359

[58] Field of Search ..... 40/23 A, 359, 360, 159, 40/61, 67, 104.19, 5, 2

[56] References Cited

U.S. PATENT DOCUMENTS 1,961,079 5/1934 Pettis ..... 40/23 A 2,889,647 6/1959 Roman ..... 40/159

FOREIGN PATENT DOCUMENTS 1,561,564 4/1970 Germany ..... 40/359

*Primary Examiner*—Louis G. Mancene
*Assistant Examiner*—Wenceslao J. Contreras
*Attorney, Agent, or Firm*—Watson, Cole, Grindle & Watson

[57] ABSTRACT

A holder for filing a plurality of data carriers. The holder is formed of a relatively flat member which has a plurality of compartments for receiving the data carriers. One of the edges of the holder is formed of a transparent material in the shape of a hollow profile edge. An identification strip is positioned within the hollow profile edge and extends along the entire length of the edge.

2 Claims, 5 Drawing Figures

DATA CARRIER HOLDER WITH IDENTIFICATION STRIP

BACKGROUND OF THE INVENTION

The present invention refers to holders, generally made of plastic, for the filing of data carriers, such as documents, film sheets and similar members, in binders, ring binders and rotating or folding structures.

In the utilization of such holders having pockets or compartments, it is desirable to provide each holder with an easily visible identification as to its contents in order to avoid having to spend long periods of time to find certain data carriers.

In previously known holders, an attempt was made to satisfy this objective by utilizing labels, so-called tags, which were glued on the pockets or frames, on which ordinal numbers or letters were indicated. These labels were generally self-supporting and projected beyond the edge of the holder so that they were exposed and easily subjected to damage.

SUMMARY OF THE INVENTION

An object of the present invention is to provide an arrangement which allows for identification of a data carrier holder in such a manner so as to avoid the above-mentioned disadvantages.

Another object of the present invention is to provide an arrangement which enables the identifying ordinal numbers or letters to be easily changed with the utilization of the same identification members.

In order to accomplish these objectives in accordance with the invention, at least one of the free unbound edges of the holder is provided with a transparent hollow profile edge for the insertion of an identification strip extending along substantially the entire length of the edge. In this manner, the identification strip is protected from outside damages thus avoiding the drawback of the above-mentioned identification tags.

In accordance with the present invention, the ordinal numerals or letters can be changed on the identification strips so that the same strip can be utilized for any of the holders. The strip has a center notch or perforation extending along its longitudinal central axis. Thus, the strip can be easily folded in half, with each half carrying the same identifications spaced at predetermined distances along the strip and at approximately the same level. At least one half of the strip has a set of lateral punches or perforations below each respective identification.

These identification strips have the advantage that they not only permit desired changes in the ordinal numerals or letters for identification of a specific holder but also can be introduced into other holders, i.e., the strips are completely re-usable.

DESCRIPTION OF THE PREFERRED EMBODIMENT

Figure 1:
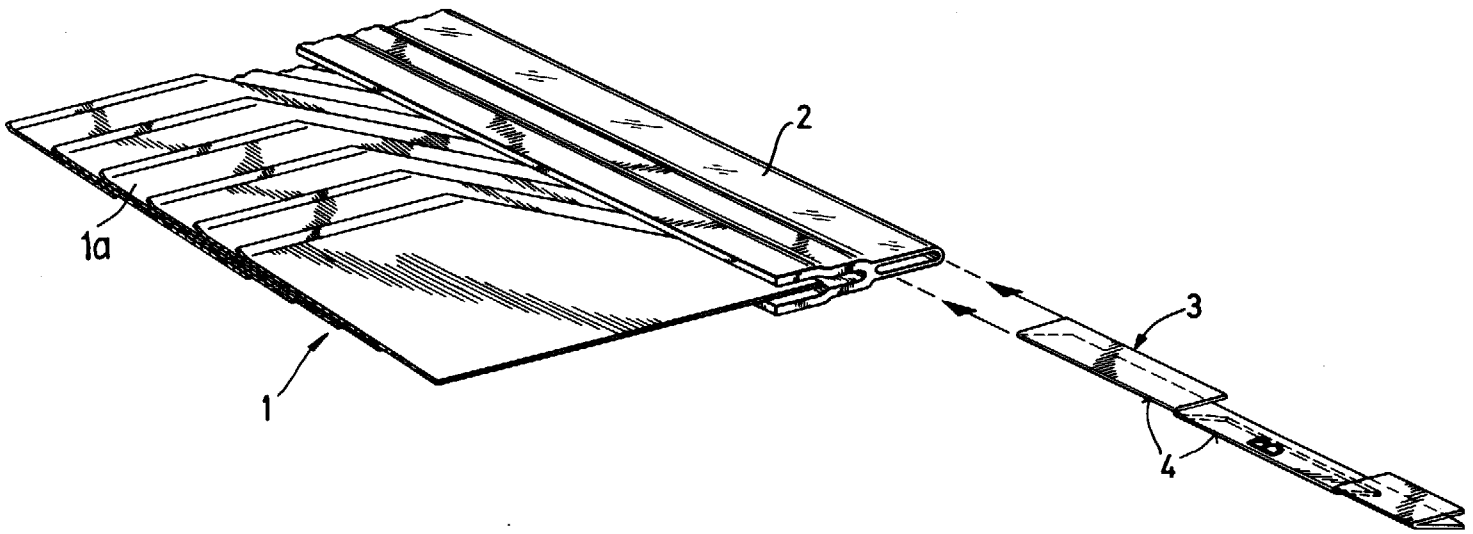
FIG. 1 is a schematic representation shown in perspective of a holder provided with a transparent hollow front edge and an identification strip to be inserted according to the present invention.
Figure 5:
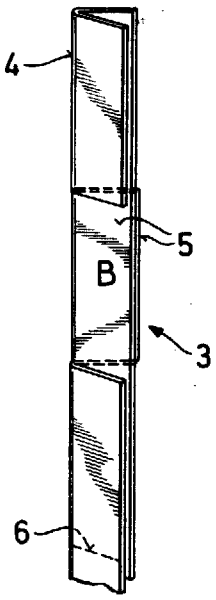
FIGS. 2 through 5 are individual representations of the identification strip shown in FIG. 1.
Figure 4:
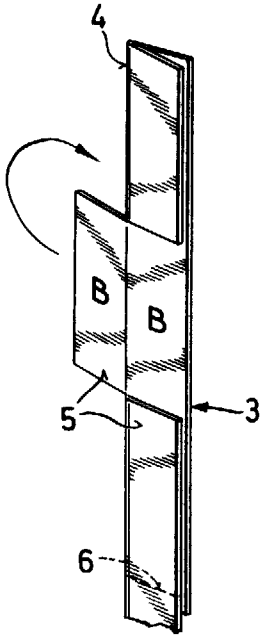
Figure 3:
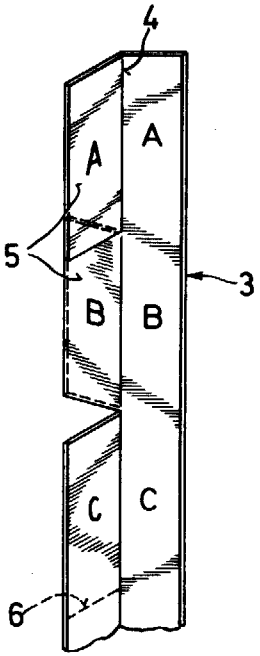
Figure 2:
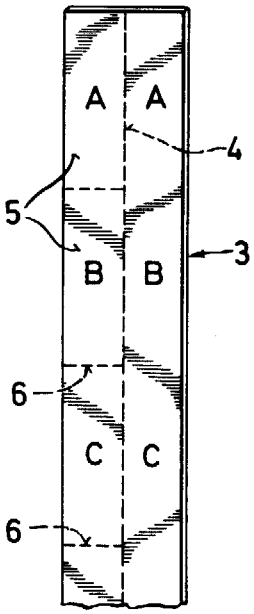

As shown in FIG. 1, holder 1, which includes pockets or compartments 1*a* for the data carriers (not shown), is equipped with a hollow profile edge 2 as its outer front edge. This hollow profile edge 2 is intended to hold an identification strip 3 which can be inserted into the edge.

Identification strip 3 has along its longitudinal central axis a notch or perforation 4 which divides it into two halves and enables it to be easily folded. The strip is inserted into hollow profile edge 2 in its folded form. The width of the hollow profile edge, therefore, should correspond in size to the width of the folded strip.

Both halves of strip 3 carry the same ordinal identifications located with the same predetermined spacing and at the same level, such as shown in FIGS. 2 through 5 by successively arranged letters A to C. The individual indicia (letter) sections 5 of at least one half of the strip are constructed so as to be separately folded or detached. For this purpose lateral punchings or perforations 6 are formed between each letter section.

In utilizing the identification strip, it is initially folded along its central axis towards the inside so that the matching letters face each other. In other words, they appear on the inside, non-visible surface of the identification strip. The desired identification section—B in FIGS. 3 to 5—is then folded towards the outside, after the appropriate perforation or perforations 6 are cut, so that both sides are visible. Since the hollow profile edge is transparent, the letter B can be read on both sides. The other sections are correspondingly treated when other letters are to be made visible, either in the same or in a different holder.

Thus, the same identification strip can be easily prepared for every ordinal numeral or letter (indicia) identificaton. Additionally, the identification strip can be removed and utilized for providing a different identification if desired.

It is noted that the above description and the accompanying drawings are provided merely to present an exemplary embodiment of the present invention and that additional modifications of this embodiment are possible within the scope of this invention without departing from the spirit thereof.

I claim:

1. A holder for the filing of data carriers such as documents or film sheets which comprises a relatively flat member having a plurality of separate compartments for receiving the data carriers; one of the edges of said relatively flat member being formed along its entire length with a transparent material in the shape of a hollow profile edge; and an identification strip positioned within said hollow profile edge and of a sufficient length to extend along the entire length of said profile edge; said identification strip being folded along a center fold line extending along its longitudinal axis such that it is divided into halves, each half having a visible outside surface and a non-visible inside surface facing the non-visible surface of the other half, said identification strip also containing laterally extending separating perforations on at least one of said halves spaced at predetermined distances along the length thereof to provide individual letter sections, said letter sections each carrying different indicia on the inside surface thereof, said identification strip also carrying the same indicia on the other divided halve of the inside surface thereof at the same length therealong and at the same level, and at least one of said separating perforations being cut and at least one of said letter sections being folded towards the outside so that the indicia on the folded letter section is made visible as well as the corresponding indicia on the other divided half of the identification strip through the hollow profile edge.

2. The holder according to claim 1 wherein said holder is made of plastic.

* * * * *